US009151059B2

(12) United States Patent
Pavlansky et al.

(10) Patent No.: US 9,151,059 B2
(45) Date of Patent: Oct. 6, 2015

(54) ROOF VENTING CLOSURE MEMBER INCLUDING CONVOLUTED FOAM

(71) Applicants: Mark Pavlansky, Elkin, NC (US); Keith Pavlansky, Yadkinville, NC (US)

(72) Inventors: Mark Pavlansky, Elkin, NC (US); Keith Pavlansky, Yadkinville, NC (US)

( * ) Notice: Subject to any disclaimer, the term of this patent is extended or adjusted under 35 U.S.C. 154(b) by 0 days.

(21) Appl. No.: 14/099,992

(22) Filed: Dec. 8, 2013

(65) Prior Publication Data

US 2014/0165481 A1 Jun. 19, 2014

Related U.S. Application Data

(60) Provisional application No. 61/734,404, filed on Dec. 7, 2012.

(51) Int. Cl.
*E04D 13/17* (2006.01)
*E04D 3/40* (2006.01)

(52) U.S. Cl.
CPC ..... *E04D 13/174* (2013.01); *E04D 3/40* (2013.01); *E04D 13/172* (2013.01)

(58) Field of Classification Search
USPC ..... 52/309.4, 309.8, 309.9, 198, 199, 43, 52/44, 302.1, 302.6; 454/250, 260, 365, 454/366, 367; 428/156, 158, 172
See application file for complete search history.

(56) References Cited

U.S. PATENT DOCUMENTS 4,024,685 A * 5/1977 Aarons ..... 52/278
5,352,154 A * 10/1994 Rotter et al. ..... 454/365
5,425,672 A * 6/1995 Rotter ..... 454/365
5,561,953 A * 10/1996 Rotter ..... 52/198
5,673,521 A * 10/1997 Coulton et al. ..... 52/199
5,826,383 A * 10/1998 Garrison ..... 52/198
6,079,166 A * 6/2000 Mason et al. ..... 52/198
6,267,668 B1 * 7/2001 Morris ..... 454/365
6,308,472 B1 * 10/2001 Coulton et al. ..... 52/198
6,418,678 B2 * 7/2002 Rotter ..... 52/199
6,458,029 B2 * 10/2002 Morris ..... 454/365
6,598,356 B1 * 7/2003 Sells ..... 52/90.1
6,599,184 B2 * 7/2003 Morris ..... 454/365
6,662,510 B2 * 12/2003 Rotter ..... 52/199
6,773,342 B2 * 8/2004 Rotter ..... 454/365
6,944,997 B2 * 9/2005 Verkamp ..... 52/309.4
6,981,916 B2 * 1/2006 Coulton ..... 454/365
7,222,463 B2 * 5/2007 Rotter ..... 52/199
7,393,273 B2 * 7/2008 Ehrman et al. ..... 454/365
7,594,363 B2 * 9/2009 Polumbus et al. ..... 52/199
8,024,897 B2 * 9/2011 Polumbus et al. ..... 52/199
8,276,331 B2 * 10/2012 Polumbus et al. ..... 52/199
8,302,352 B2 * 11/2012 Bahn ..... 52/199
8,806,823 B2 * 8/2014 Polumbus ..... 52/404.1
2005/0069693 A1 * 3/2005 Hofmann ..... 428/317.7
2005/0126088 A1 * 6/2005 Rotter ..... 52/198

(Continued)

*Primary Examiner* — Brent W Herring

(57) ABSTRACT

A roofing system, especially suited for use with metal roofing panels includes a V-shaped vent cover located above an air circulation vent at the crest or apex of a sloping roof. A vent closure strip in the form of a composite member is located in the gap between the vent cover and the roofing panels, which contain a series of ribs or protrusions forming an uneven surface. An air impermeable backing strip, which can be a closed cell foam, includes fastening blocks through which fasteners extend to fasten the vent cover to the roofing panels. Air permeable members are adhered to the backing strip. These air permeable members can be a reticulated foam with a convoluted lower surface for compressively conforming to the uneven upper surface of the roofing panels. The air permeable members are more porous and more dense than the air impermeable members.

10 Claims, 9 Drawing Sheets

(56) References Cited

U.S. PATENT DOCUMENTS

2006/0096189 A1* 5/2006 Pavlansky et al. ..... 52/198
2006/0154597 A1* 7/2006 Coulton et al. ..... 454/365
2008/0220714 A1* 9/2008 Caruso et al. ..... 454/365

* cited by examiner

ROOF VENTING CLOSURE MEMBER INCLUDING CONVOLUTED FOAM

CROSS REFERENCE TO PRIOR CO-PENDING APPLICATION

This application claims the benefit of prior U.S. Provisional Patent Application 61/734,404 filed Dec. 7, 2012.

BACKGROUND OF THE INVENTION

1. Field of the Invention

This invention relates to a vent closure member formed of a closed cell, air impermeable backing member and air permeable foam members, to close the gap between metal or other roofing panels and a v-shaped ridge vent cover, in order to permit air circulation but prevent entry of wind driven rain and insects.

2. Description of the Prior Art

Metal roofing has become an accepted material that provides a high quality and long lasting roof. Numerous manufacturers of metal roofing panels will typically each have some unique difference in the profile of their own metal panel. Each manufacturer therefore has their own specialized signature profile. The profile of the metal roof when viewed from the end leaves openings that might allow for the penetration by wind driven precipitation, or openings through which birds, insects and other creatures can gain entrance into a roofing system. Closing these gaps has been necessary to prevent the intrusion of foreign debris, acoustic energy, and precipitation from gaining entrance to the roofing system.

The manufacture of gaskets or closure strips used to cover the gaps has been widely used since the 1970's. These gaps and voids need to be filled in order to have an effective roof system. Materials used to close these gaps and voids are known as closure strips. Historically rubber materials including ethylene propylene diene monomer (EPDM) and vinyl nitrile were used in the construction of metal buildings and metal roofing as closure strips to prevent water and insects from penetrating the joints of the metal building. In the 1970's it was discovered that polyethylene foam could perform similarly to the EPDM and vinyl nitrile products previously employed for closure strips. The polyethylene worked well because it was closed cell and was light weight (2 lb/ft.3), but had problems with oxidation and premature aging. The preferred material in the industry became crosslinked polyethylene which didn't have the oxidation problem that linear polyethylene had. One of the major disadvantages of using crosslinked polyethylene, however, was availability from manufacturers, from whom it could not be reliably purchased. Production in other markets often limited the availability of crosslink polyethylene in the metal building markets. The substitution of alternate materials has therefore been under investigation for some time. Substitute materials that have been investigated to overcome physical short comings of the cross linked polyethylene, which included that fact that it is non recyclable which adds to manufacturing costs; cross linked polyethylene had no UV stabilizer, which would help to extend the life span of the product; the original Crosslink product had no fire resistant properties; and the crosslink product had substantial shrinkage problems at elevated temperatures, which allowed the ready passage of rain water and insects. Typical metal roof temperatures during warmer months will reach 180° Fahrenheit, and can even reach 200° Fahrenheit on extremely warm days.

Initial development resulted in a material known as "Soft cell", which matched the physical performance characteristics of the crosslink closure, had UV stabilization, had F/R, was micro cellular, and was recyclable. A second iteration of material was called GF-1, which exceeds the physical characteristics of crosslink polyethylene in compressive strength, thermal stability, UV resistance, tear resistance, thermal stability, and density, Both products were marketable, as manufacturing costs to produce the GF-1 strips were lower than that of crosslink polyethylene. While they both performed well for the application, and had significant advantages over the crosslink polyethylene, the base resin was linear polyethylene, and at elevated temperatures seen on most buildings as high as 200° F., crosslinked and linear polyethylene were limited in their capability. The low level of thermal stability for both crosslinked and linear polyethylene caused them to shrink at the high temperature levels. It was at this point a third iteration was investigated that would not only continue to exhibit the UV stability, recyclability, compressive strength, F/R, tear resistance, but would also have thermal stability at higher temperatures which would not show signs of shrinkage. This approach involved foaming polypropylene which as a base resin has a greater heat resistance as high as 280° F., which is in excess of the requirements of metal roofing and metal buildings.

U.S. Pat. No. 8,276,331 discloses a sealant strip that can be located between a roof and a ridge cap. That device has an air impermeable section that is cut to engage the contoured surface of the roof, such as the ridges or protrusions on a metal roofing panel. A series of rectangular air permeable members engage the flat lower surface of the ridge cap. In that device, the air permeable members are less dense than the air impermeable members.

SUMMARY OF THE INVENTION

A roof venting closure member according to this invention will allow air flow through a roof vent while restricting flow of liquids and moisture through the roof vent. This roof venting closure member will include a backing member having elongate sections and a plurality of spaced fastener blocks extending downward from the backing member. These fastener blocks will support a vent cover above a roof and in engagement with an upper surface of the backing member. Air permeable foam members, having a lower compression strength than and being more resilient than the elongate backing member and the spaced fastener blocks, extend between adjacent fastener blocks below the elongate sections of the backing member. In the preferred embodiment of this invention, the air permeable foam members have a convoluted lower surface characterized by a plurality of peaks with serpentine channels extending around the peaks between a front and a rear face of the each air permeable member. The convoluted lower surface is more readily deformable than remaining portions of the air permeable foam member from which the peaks extend so that the convoluted lower surface of the air permeable foam member compressively conforms to projections extending upwardly from roofing panels forming the roof when the roof venting closure member is assembled between the roof and the vent cover.

According to another aspect of this invention, a ridge vent roofing system covers a vent opening at the crest of a sloped roof on which metal roofing panels are mounted. The ridge vent roofing system includes a ridge vent cover securable to the roof over the vent opening and a closure strip securable between the ridge vent cover and the metal roofing panels. The closure strip is air permeable but restricts the passage of liquids and insects. The closure strip has a backing strip to which at least one air permeable foam member is attached.

The air permeable foam member has a convoluted lower surface more readily compressible than remaining portions of the closure strip. The convoluted surfaces engages an uneven upper surface on the roofing panels, with serpentine channels formed on the convoluted lower surface remaining open to permit the passage of air but restrict passage of liquids and insects due to the shape of the serpentine channels.

The convoluted surface is not present in another aspect of this invention. That roof venting closure member allows air flow through a roof vent while restricting flow of liquids and water vapor through the roof vent and between a ridge vent cover and uneven roofing panels. This roof venting closure member includes a backing member having elongate sections and a plurality of spaced fastener blocks extending downward from the backing member to support a vent cover above a roof and in engagement with an upper surface of the backing member. The backing member can be a one piece member formed of a closed cell foam. Air permeable foam members, having a lower compression strength than and being more resilient than the elongate backing member and the spaced fastener blocks, extend between adjacent fastener blocks below the elongate sections of the backing member. The air permeable foam members have a density greater than the density of the backing member. The air permeable foam member compressively conform to projections extending upwardly from roofing panels forming the roof when the roof venting closure member is assembled between the roof and the vent cover.

DETAILED DESCRIPTION OF THE PREFERRED EMBODIMENT

Figure 1:
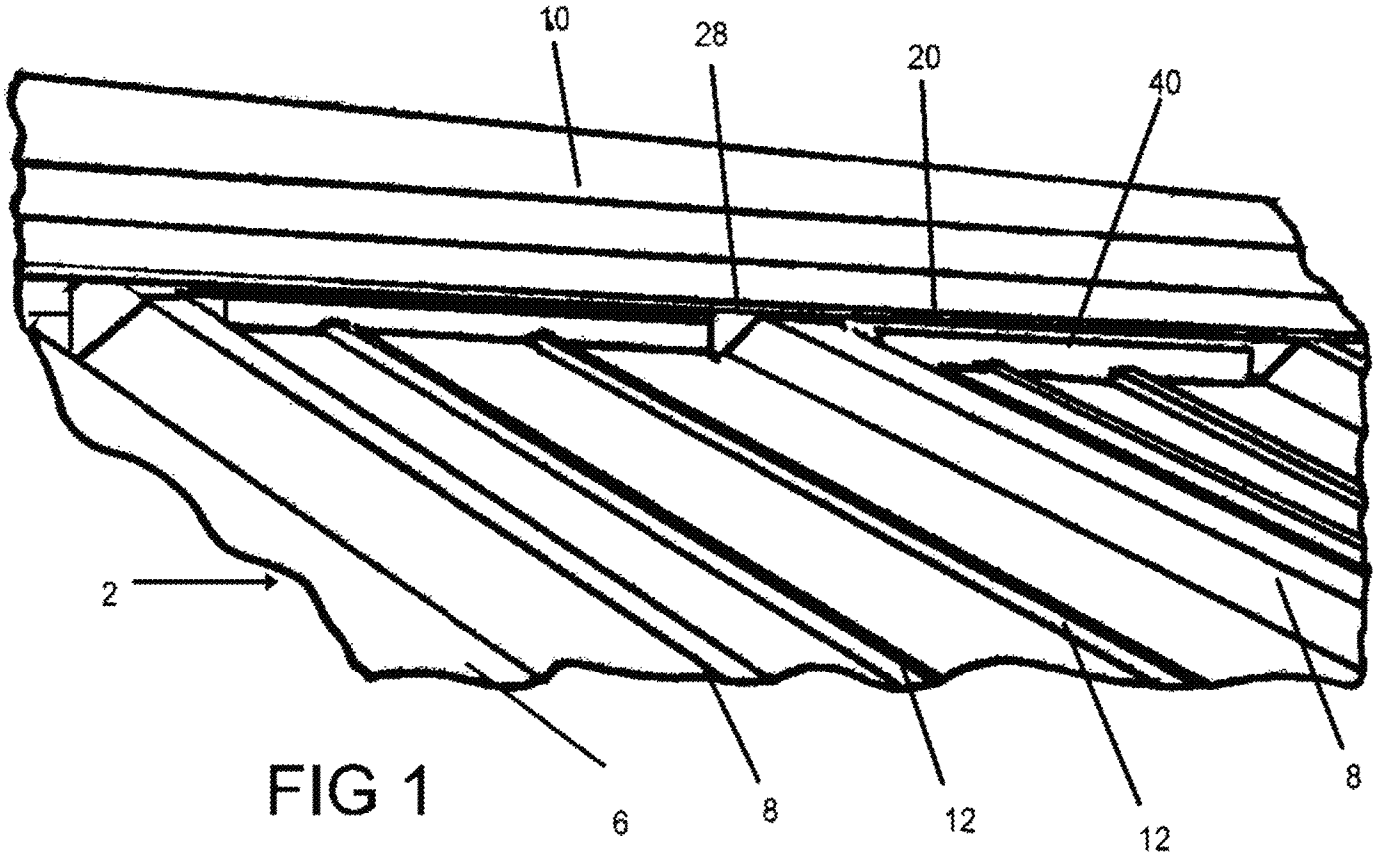
FIG. 1 is a view of a roofing system including a vent cover at the crest of a sloped roof including metal roofing panels, with a vent closure member located between the roofing panels and the vent cover.
Figure 7:
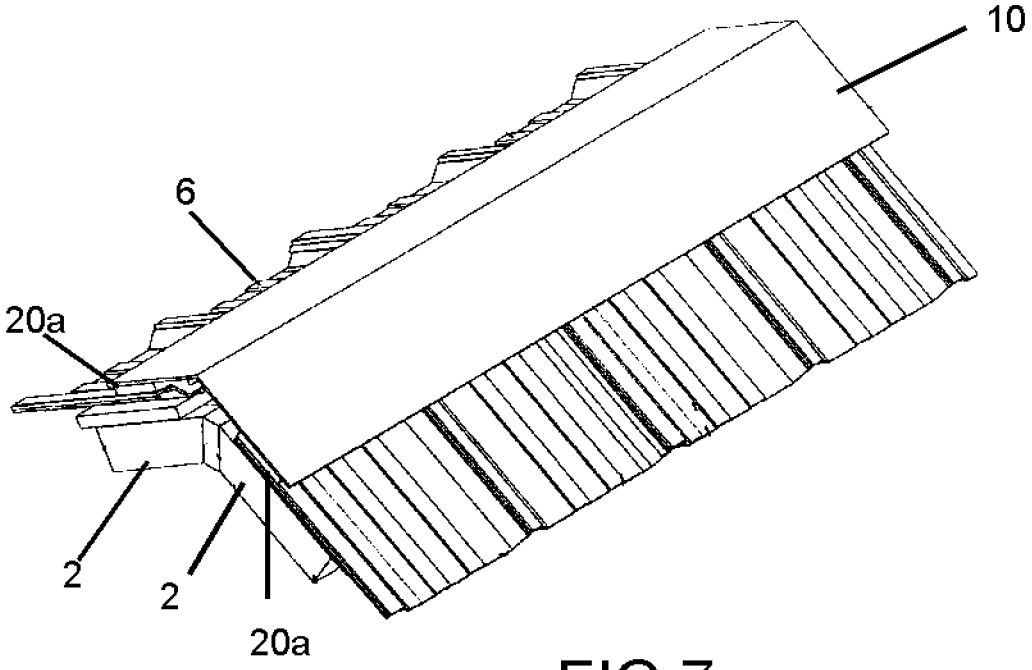
FIG 7 PRIOR ART
FIG. 7 is a view of a prior art vent closure assembly.

FIG. 1 shows the main components of the preferred embodiment of the roofing system depicted herein. The embodiment of FIG. 1 is similar to the Prior Art embodiment of FIG. 7, but the vent closure member 20 differs from the prior art vent closure member 20*a* shown in FIG. 7. In each case the vent closure member is positioned between roofing panels 6 and the vent cover 10. Sloping roof 2 has a plurality of metal panels 6, which slope downward from a vent in the form of an elongate slot extending along the crest or apex of the roof. In FIG. 1, the vent, formed by the spaced upper ends of the roofing panels 6 is covered by a V-shaped vent cover 10. Only one side of this V-shaped vent cover 10 is show in FIG. 1, but this vent cover is a conventional V-shaped metal stamping that is normally used with roofing panels 10 depicted herein. This V-shaped vent cover 10 can also be used with other roofing panel configurations and shapes. The vent cover 10 has a flat lower surface extending over the upper ends of the roofing panels 6, or at least a portion of vent cover 10 near its lower edges would be flat. The lateral contour of the vent cover 10 does not conform to the lateral contour of the roofing panels 6, and a space will remain between the vent cover 10 and the roofing panels 6, which the cover overlaps. The gap between the vent cover 10 and the roofing panels 6 allows air to circulate through the vent opening at the crest of the sloping roof 2, and the cover 10 normally prevents rain or other liquids from directly entering the vent opening. However, wind driven rain could penetrate beneath the vent cover 10 and enter the vent in the absence of an air permeable vent closure member located in the gap between the roofing panel 6 and the vent cover 10.

The roofing panels 6, depicted herein, are one, but not the only, configuration of metal roofing panels that can be employed with a sloping roof 2. The roofing panels 6 are formed in sections, which will overlap along their edges when assembled on a roof. In the embodiment depicted herein, each panel section has a primary rib 8 located at each end and additional primary ribs 8 extend between the end primary ribs 8. When the panel sections are positioned in overlapping relationship, one end primary rib 8 will extend beneath an overlapping primary rib 8 on the next panel section. A series of secondary or stiffener ribs 12 would extend parallel to the primary ribs 8. In the embodiment depicted herein, two secondary or stiffener ribs 12 will extend between adjacent primary ribs. The height of these secondary or stiffener ribs 12 is significantly less than the height of the primary ribs 8. Because of the protruding ribs 8 and 12, the upper surface of the roofing panels 6 is uneven and will not fit smoothly against the flat lower surface of the vent cover 10. Of course a smooth fit is not desirable, because a gap should remain for air circulation between the exterior and interior of the building with which this roofing system is employed. It should be understood that the shape of the roofing panels 6, depicted herein is not the only shape that could be employed in a metal roofing system, and this configuration is merely representative on one of several shapes that are employed or can be employed now of may be employed in the future.

Figure 2A:
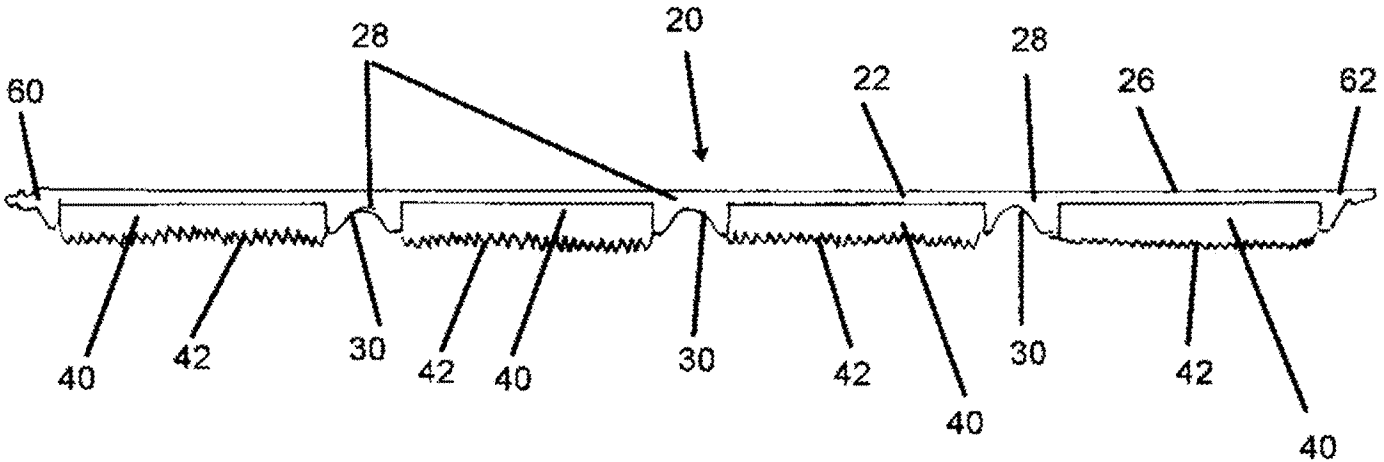
FIGS. 2A and 2B are side views of a vent closure member according to this invention. the scale of FIG. 2A is larger than the scale of FIG. 2B, but FIG. 2B is consistent with the relative dimensions of a representative embodiment of the vent closure member of this invention.
Figure 2B:
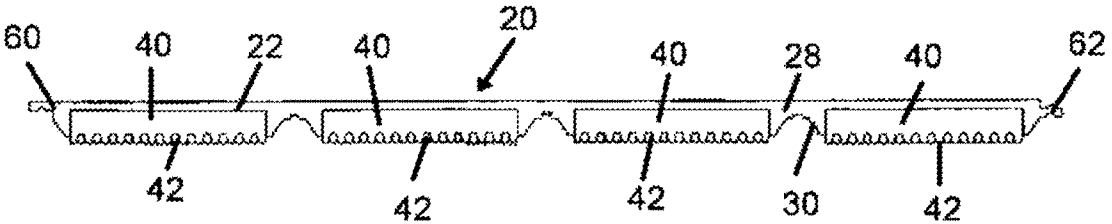
Figure 3A:
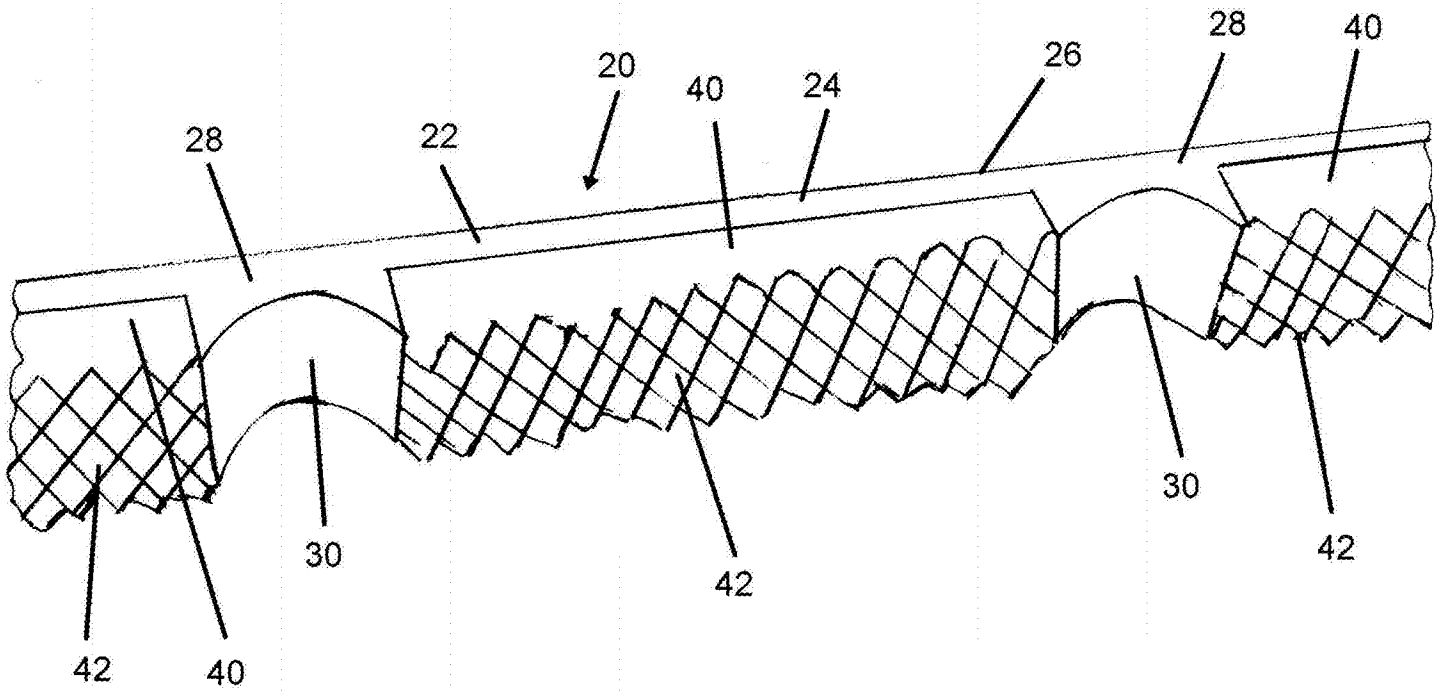
FIG. 3A is a perspective view of a vent closure member according to this invention with the lower convoluted surface of the air permeable foam members being shown in this view.
Figure 3B:
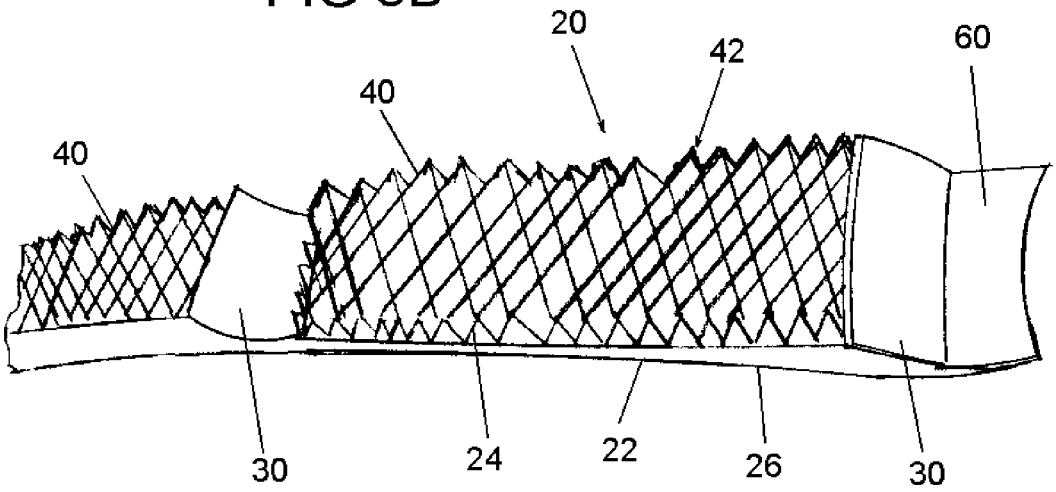
FIG. 3B is a photograph, also showing the convoluted surface of the air permeable foam members and a fastener block, but showing the convoluted fiber in more detail.

In order to prevent entry of wind driven rain, wind driven debris or dust or other liquids or insects through the gap between metal roofing panels 6 and an associated vent cover 10, a roof venting closure member 20 is employed. This venting closure member 20 is shown in FIGS. 2A, 2B and 3. The preferred embodiment of closure member 20 has four air permeable, generally rectangular foam members 40 that are secured to an air impermeable backing member 22. In the preferred embodiment of this invention, an adhesive secures the air permeable foam members 40 to the backing member 22. In the preferred embodiment of this invention, the air permeable members 40 are formed from a reticulated foam material and the air impermeable backing member 22 is formed from a closed cell foam. The backing member 22 has thin elongate sections 24 interrupted by fastener blocks 28 protruding downwardly. The backing member 22 has a flat upper surface 26 that will engage the flat lower surface of a vent cover 10, when positioned between the vent cover 10 and the metal roofing panels 6. Air permeable foam 40 will be positioned between the fastener blocks 28 along the lower surface of the backing member elongate sections 24. In this embodiment, the fastener blocks 28 are spaced apart so that they will be positioned over the primary ribs 8 when located between the roofing panels 6 and the vent cover 10. The fastener blocks 28 are thicker than the remainder of the backing member 22, and will remain intact when a fastener, such as a nail or screw, is driven through the fastener block 28 and into the primary ribs 8 to fasten the vent cover 10 to the metal roofing panels 10. The lower surface of each fastener block forms a seat 30 that will fit over the top of the corresponding primary rib 8 on the metal roofing panel 6. The shape of the seat 30 will conform to the shape of the primary rib 8. When the closure strip 20 is mounted between the metal roofing panel 8 and the vent cover 10, the backing member 22 and the fastener block 28 will not deform to the same extent as the air permeable foam members 40. In the preferred embodiment, sections of the venting closure member 20 will be formed end to end along the roof. Mating extensions 60 and 62, along opposite ends, will mate with adjacent strips to form a two part fastener block section where the ends meet.

In the preferred embodiment of this invention, the air permeable member 40 is formed of a reticulated foam. Other open cell foams can be employed, but a reticulated foam is preferred. To form the reticulated foam, chemical and or heat is applied to a foam, and the walls of the foam member are broken to increase the porosity of the foam to allow air to pass through the foam. In a closed cell foam, thin walls or membranes form around air bubbles, and although most of the closed cell foam volume consists of air, continuous pathways for air to flow through the closed cell foam are not present. In an open cell foam or a reticulated foam, these walls or membranes have been broken down. This process not only increases the porosity, but the density of the foam material will also increase, because there membranes can collapse relative to each other, but the reticulated foam will also be more compliant than the closed cell foam. So that the reticulated foam can withstand environmental conditions that will be expected when used as part of a roofing system, a flame retardant ultraviolet resistant acrylic latex coating is applied to the reticulated foam member. The density of this composite, reticulated air permeable foam member 40 will thus be greater than the density of the more rigid, closed cell foam forming the backing member 22 and its fastener blocks 28.

Figure 4A:
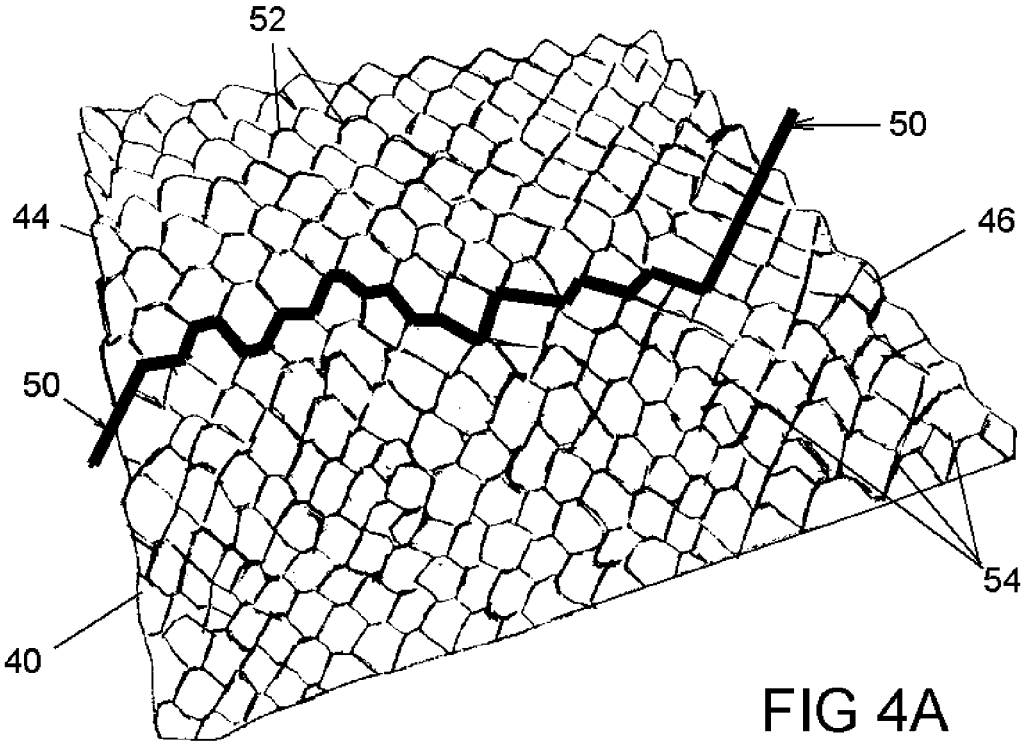
FIG. 4A is a photographic view showing a convoluted surface of a foam member illustrating an example of one of the serpentine channels formed on the convoluted surface.
Figure 4B:
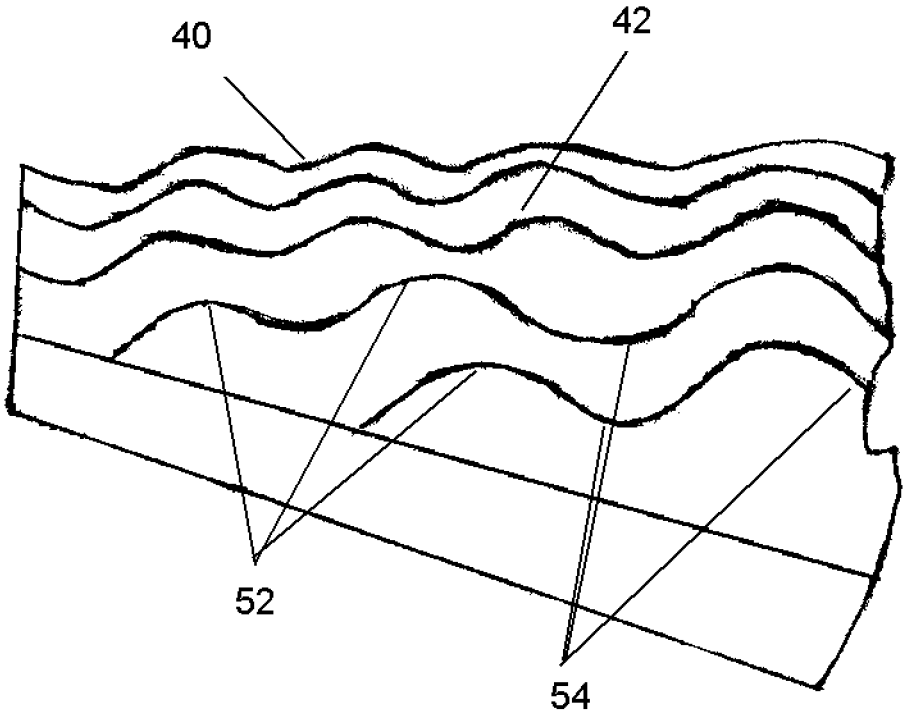
FIG. 4B is a photograph taken at a shallower angle to show how the peaks protrude above the valleys in a convoluted foam surface.
Figure 5:
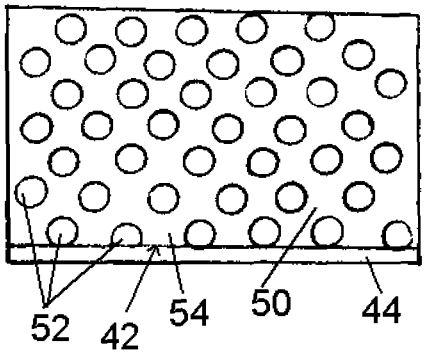
FIG. 5 is a view of the lower convoluted surface of the air permeable member used in the preferred embodiment of this invention, also showing a serpentine channel according to this invention.

The air permeable foam members 40 must also conform to the uneven top surface of the roofing panels 40. In the preferred embodiment, the air permeable foam members 40 must conform to the contour created by the secondary stiffening ribs 12. In the preferred embodiment, the lower surface of the air permeable members 40 is a convoluted surface 42 formed by a peaks 52 and valleys 54. These valleys 54 are interconnected to form continuous serpentine, and or oblique channels 50 that extend between the front 44 and the rear 46 of the closure member 20. Because the compressive strength of most flexible foams, and especially the breathable foam used herein is low, it lends itself to a convoluting cutting process very well. The foam used in the backing member 22 which is actually less dense, but has a greater compressive strength therefore lends itself poorly to the convoluting process. The air permeable foam we are using has a low compressive strength, and even though its density is higher than the portion of the strip it's adhered to, it lends well to being convoluted. FIG. 4 illustrates how serpentine channels 50 can be formed along a convoluted foam surface. FIG. 5 is a photograph of a portion of the actual foam that is used to form the air permeable foam members 40.

Since the peaks 52 can be even more readily compressively deformed than the remainder of the reticulated foam block, the convoluted lower surface 42 will more readily conform to irregularities or protrusions such as the secondary of stiffening ribs 12 engaged by the air permeable members. Since the portion of convoluted surface 42 will be compressed to a greater extent over the protrusions than over the remainder of the metal roofing panels, the serpentine channels 50 will remain more open than those portions over the stiffening ribs 12. However, these serpentine channels 50, while remaining open, will not allow passage of liquids, such as wind driven rain. In addition to the fact that the vent closure member 20 is sloped upward along the roof, the serpentine or oblique nature of the channels 50 will interfere with the passage of wind driven rain, moisture, dust or debris. The serpentine nature of the channels 50 should also retard the migration of insects. Air will however pass through the body of the air permeable foam members 40 and around the air permeable foam members 40 through the serpentine channels 50.

The higher density of the air permeable foam relative to the air impermeable foam is believed to be important in maintaining the integrity of the peak sections 52 along the convoluted surface 42. If these peak sections 52 are too fragile, then gaps can be created in the event of damage or wear to the convoluted foam. The convoluted, reticulated air permeable foam therefore needs to have a sufficient mass of material in order to retain its integrity. The closed cell foam, forming the backing member 22 and the fastener blocks 28 are only less conformable than the air permeable members, and the membranes forming air pockets in a closed cell foam of lesser density would be sufficient for that purpose.

Figure 6:
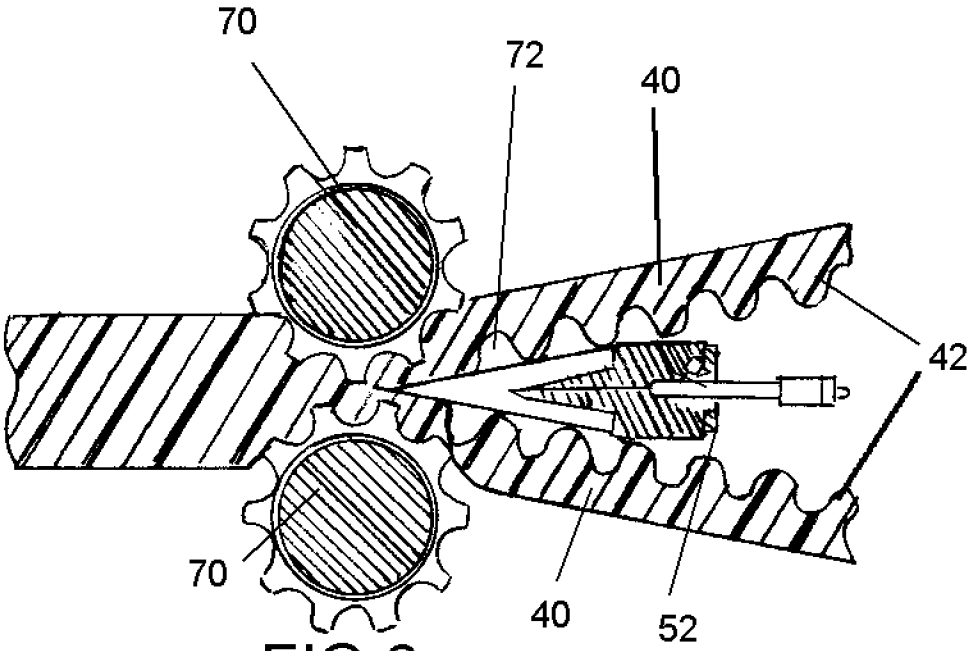
FIG. 6 is a view showing how a convoluted surface would be formed on an air permeable foam member of the type that would be employed in the representative embodiment of the invention depicted herein.

The manner in which the foam is fabricated to form the convoluted surface 42 is demonstrated in FIG. 6. A sheet of compressible, reticulated foam is fed through rollers 70 that have fingers in the shape of the peaks extending around their interior. As the foam moves from left to right in FIG. 6, a continuous bandknife 72 will cut the foam sheet into two sheets having a smaller thickness, but with an exposed convoluted surface. FIG. 6 shows only one section, and the protruding fingers along the axis of the rollers 70 will be offset, so that the peaks will be offset, thus forming the serpentine channels 50 on the convoluted air permeable foam that will be used in the air permeable foam members 40.

The use of convoluted air permeable foam members 40 also allows the roof venting closure members 20 to be employed with roofing panels that may have different shapes. As long as the fastener block seat 30 will fit over protrusions, such as the primary ribs 8, the compressible, reticulated, convoluted foam members 40 will conform to different shapes. For example the same closure strips 20 could be used with roofing panels having secondary stiffening ribs 12 of different heights and spacings, as well as different widths or numbers. The same closure strip could also be used for corrugated roofing panels in which the corrugated shape was substantially the same as the shape of the fastener block seat 30. It should also be understood that the shape of the air permeable foam members 40 and the air impermeable backing members 22 could be altered to fit other roofing panel configurations.

We claim:

1. A roof venting closure member allowing air flow through a roof vent while restricting flow of liquids and moisture through the roof vent, the roof venting closure member comprising:

a backing member having elongate sections and a plurality of spaced fastener blocks extending downward from the backing member to support a vent cover above a roof and in engagement with an upper surface of the backing member, each elongate section and adjacent fastener blocks comprising a one-piece foam member;

air permeable foam members, having a lower compression strength than and being more resilient than the elongate sections and the spaced fastener blocks, each air permeable member being secured to the backing member and extending between adjacent fastener blocks below the elongate member, the air permeable foam members having a convoluted lower surface characterized by a plurality of peaks with serpentine channels extending around the peaks between a front and a rear face of the each air permeable member, the convoluted lower surface being more readily deformable than remaining portions of the air permeable foam member from which the peaks extend so that the convoluted lower surface of the air permeable foam member locally compressively conforms to projections extending upwardly from roofing panels forming the roof when the roof venting closure member is assembled between the roof and the vent cover with the backing member and the fastener blocks preventing deformation of the air permeable foam members where not engaged by the projections extending upwardly from roofing panels, so that the serpentine channels remain open.

2. The roof venting closure member of claim 1 wherein backing member is air and liquid impermeable.

3. The roof venting closure member of claim 2 wherein the backing member comprises a closed cell foam member.

4. The roof venting closure member of claim 3 wherein the closed cell foam backing member has a density that is less than the air permeable foam member.

5. The roof venting closure member of claim 4 wherein the air permeable foam member comprises a reticulated foam member.

6. The roof venting closure member of claim 4 wherein air pockets formed between membranes reduce the density of the closed cell foam members and reticulated foam membranes form a partially collapsed structure in which reticulated foam air passages form continuous air passages even though the reticulated foam member has a greater density than the closed cell foam backing member.

7. The roof venting closure member of claim 4 wherein the closed cell foam backing member has a mass density that is less than the mass density of the air permeable member.

8. The roof venting closure member of claim 1 wherein serpentine channels in the air permeable foam member extend between adjacent fastener blocks.

9. The roof venting closure member of claim 1 wherein the fastener blocks each have a lower surface forming a seat for engaging a rib on roofing panels forming the roof.

10. The roof venting closure member of claim 1 wherein a flame retardant ultraviolet resistant acrylic latex coating is applied to the convoluted foam member so that the convoluted foam member can be exposed as part of a roof venting system on a roof with air passes through the convoluted foam member and the serpentine channels in the presence of the flame retardant ultraviolet resistant acrylic latex coating.

* * * * *